US007278397B2

(12) United States Patent
Kobayashi

(10) Patent No.: US 7,278,397 B2
(45) Date of Patent: Oct. 9, 2007

(54) CONTROL APPARATUS FOR INTERNAL COMBUSTION ENGINE

(75) Inventor: Daisuke Kobayashi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/354,876

(22) Filed: Feb. 16, 2006

(65) Prior Publication Data

US 2006/0207560 A1 Sep. 21, 2006

(30) Foreign Application Priority Data

Mar. 18, 2005 (JP) ..... 2005-078360

(51) Int. Cl.
*F02B 1/10* (2006.01)

(52) U.S. Cl. ..... 123/431; 123/299; 123/300; 123/686

(58) Field of Classification Search ..... 123/299, 123/300, 431, 491, 685, 686
See application file for complete search history.

(56) References Cited

U.S. PATENT DOCUMENTS

2001/0039936 A1 11/2001 Ichihara et al.
2002/0170541 A1 11/2002 Machida et al.
2005/0066939 A1 3/2005 Shimada et al.

FOREIGN PATENT DOCUMENTS

| | | |
|---|---|---|
| EP | 1 138 901 A2 | 10/2001 |
| EP | 1 260 695 A2 | 11/2002 |
| JP | A-05-231221 | 9/1993 |
| JP | A-11-303669 | 11/1999 |

*Primary Examiner*—Erick Solis
(74) *Attorney, Agent, or Firm*—Oliff & Berridge, PLC

(57) ABSTRACT

An Engine ECU executes a program including the steps of: calculating (S100) a wall deposit correction quantity fmw, a DI reference injection quantity taudb of an in-cylinder injector, and a PFI reference injection quantity taupb of an intake manifold injector; sensing (S200) an engine coolant temperature THW; if THW is higher than a THW threshold value (YES in S300) and DI ratio r is not 100% (NO in S400), making a correction (S600) with wall deposit correction quantity fmw using the intake manifold injector; if THW is at most THW threshold value (NO in S300), making a correction (S500) with wall deposit correction quantity fmw using the in-cylinder injector.

10 Claims, 8 Drawing Sheets

CONTROL APPARATUS FOR INTERNAL COMBUSTION ENGINE

This nonprovisional application is based on Japanese Patent Application No. 2005-078360 filed with the Japan Patent Office on Mar. 18, 2005, the entire contents of which are hereby incorporated by reference.

BACKGROUND OF THE INVENTION

1. Field of the Invention

The present invention relates to a control apparatus for an internal combustion engine having a first fuel injection mechanism (an in-cylinder injector) for injecting fuel into a cylinder and a second fuel injection mechanism (an intake manifold injector) for injecting fuel into an intake manifold or an intake port, and relates particularly to a technique for making a correction for a quantity of fuel deposited on an internal wall of an intake port when a load required for the internal combustion engine is changed.

2. Description of the Background Art

An internal combustion engine having an intake manifold injector for injecting fuel into an intake manifold of the engine and an in-cylinder injector for injecting fuel into a combustion chamber of the engine, and configured to determine a fuel injection ratio between the intake manifold injector and the in-cylinder injector based on an engine speed and an engine load, is known. In this internal combustion engine, a total injection quantity corresponding to the sum of the fuel injected from both fuel injection valves is predetermined as a function of the engine load, and the total injection quantity is increased as the engine load is greater.

In such an internal combustion engine, when the engine load has exceeded a set load and a fuel injection from the intake manifold injector is initiated, part of the fuel injected from the intake manifold injector deposits on an internal wall of the intake manifold. As a result, the fuel supplied from the intake manifold to the combustion chamber of the engine is smaller in quantity than the fuel having been injected from the in-cylinder injector. Accordingly, if the fuel is injected from each of the fuel injection valves based on the injection quantity predetermined as a function of the engine load, when fuel injection from the intake manifold injector is started, a fuel quantity actually supplied to the engine combustion chamber becomes smaller than a requested fuel quantity (a lean state). Thus, a problem arises that the output torque of the engine temporarily drops.

Additionally, in such an internal combustion engine, when the engine load has dropped lower than a set load and fuel injection from the intake manifold injector is stopped, the fuel deposited on the internal wall of the intake manifold is continued to be supplied to the engine combustion chamber. As a result, if fuel is injected from each of the fuel injection valves based on the injection quantity predetermined as a function of the engine load, when fuel injection from the intake manifold injector is stopped, a fuel quantity actually supplied to the engine combustion chamber becomes greater than a requested fuel quantity (a rich state). Thus, a problem arises that the output torque of the engine temporarily rises.

Japanese Patent Laying-Open No. 5-231221 discloses a fuel injection type internal combustion engine including an in-cylinder injector for injecting fuel into a cylinder and an intake manifold injector for injecting fuel into an intake manifold or an intake port, for preventing fluctuations in engine output torque when starting and stopping port injection. The fuel injection type internal combustion engine includes a first fuel injection valve (an intake manifold injector) for injecting fuel into an engine intake manifold and a second fuel injection valve (an in-cylinder injector) for injecting the fuel into an engine combustion chamber, wherein, when an engine operation state is in a predetermined operation range, fuel injection from the first fuel injection valve is stopped, and when an engine operation state is not in the predetermined operation range, the fuel is injected from the first fuel injection valve. The fuel injection type internal combustion engine includes means for estimating a deposited fuel quantity on an intake manifold internal wall when fuel injection from the first fuel injection valve is started, and for estimating a flow-in quantity of the deposited fuel flowing into the engine combustion chamber when fuel injection from the first fuel injection valve is stopped, and means for correcting a fuel quantity injected from the second fuel injection valve to be increased by the above-mentioned deposited fuel quantity when the fuel injection from the first fuel injection valve is started, and for correcting a fuel quantity injected from the second fuel injection valve to be decreased by the above-mentioned flow-in quantity when the fuel injection from the first fuel injection valve is stopped.

According to the fuel injection type internal combustion engine, by correcting a fuel quantity injected from the second fuel injection valve to be increased by a deposited fuel quantity when fuel injection from the first fuel injection valve is started, a fuel quantity actually supplied to the engine combustion chamber satisfies a required fuel quantity; by correcting the fuel quantity injected from the second fuel injection valve to be decreased by a flow-in quantity when fuel injection from the first fuel injection valve is stopped, a fuel quantity actually supplied to the engine combustion chamber satisfies a required fuel quantity. As a result, in either case of starting and stopping the fuel supply from the first fuel injection valve, a fuel quantity supplied to engine combustion chamber satisfies a required fuel quantity, and therefore the engine output torque is prevented from being fluctuated.

However, in the fuel injection type internal combustion engine disclosed in Japanese Patent Laying-Open No. 5-231221, a fuel quantity injected from the second fuel injection valve (in-cylinder injector) is corrected, only when fuel injection from the first fuel injection valve (intake manifold injector) that has not been performed is started, or when fuel injection from the first fuel injection valve (intake manifold injector) that has been performed is stopped. Specifically, it addresses: the case where DI ratio r (a ratio of a quantity of fuel injected from the in-cylinder injector to a total quantity of the fuel being injected) changes from 1 (from a state where fuel is injected solely from the in-cylinder injector to a state where fuel injection from the intake manifold injector is started); or the case where DI ratio r changes from 0 (from a state where the fuel is injected solely from the intake manifold injector to a state where fuel injection from the in-cylinder injector is started). Here, the wall deposited fuel associated with turning ON/OFF of the intake manifold injector is corrected using the in-cylinder injector. Thus, as the correction of the wall-deposited fuel is made using the in-cylinder injector, and not the intake manifold injector that has caused the deposit, a fuel injection quantity from the in-cylinder injector is affected by a correction quantity (a correction to increase and a correction to decrease) and the DI ratio greatly deviates from the ratio calculated under the operation conditions of the internal combustion engine.

SUMMARY OF THE INVENTION

An object of the present invention is to provide a control apparatus for an internal combustion engine having first and second fuel injection mechanisms bearing shares, respectively, of injecting fuel into a cylinder and an intake manifold, respectively, that can appropriately make a correction for fuel deposited on a wall without largely changing a fuel injection ratio.

A control apparatus for an internal combustion engine according to the present invention controls an internal combustion engine having a first fuel injection mechanism injecting fuel into a cylinder and a second fuel injection mechanism injecting the fuel into an intake manifold. The control apparatus includes a controller controlling the first and second fuel injection mechanisms to bear shares, respectively, of injecting the fuel based on a condition required for the internal combustion engine, and an estimator estimating a wall-deposited fuel of the intake manifold. The controller controls the first and second fuel injection mechanisms, in a range where the first and second fuel injection mechanisms bear shares, respectively, of a fuel injection quantity, so that a correction for the wall-deposited fuel is made using the second fuel injection mechanism.

According to a first aspect of the present invention, when a request that increases a load to the internal combustion engine (when the accelerator pedal is pressed) arises when the first fuel injection mechanism (for example, an in-cylinder injector) and the second fuel injection mechanism (for example, an intake manifold injector) bear shares, respectively, of injecting the fuel (0<DI ratio r<1), both of the fuel injection quantity of the in-cylinder injector and that of the intake manifold injector increase. Here, the fuel suctioned into the combustion chamber (into the cylinder) decreases until a prescribed quantity of fuel is deposited on the intake manifold (intake port). As this state would result in a lean air-fuel ratio, a correction is made for the fuel deposited on the wall. Specifically, a correction is made to increase the fuel injection quantity. Here, the correction is made using the intake manifold injector. If a DI ratio r (0<r) decreases stepwise (with a load to the internal combustion engine being the same) when the in-cylinder injector and the intake manifold injector) bear shares, respectively, of injecting the fuel (0<DI ratio r<1), the fuel injection quantity of the intake manifold injector increases stepwise. Here, the fuel suctioned into the combustion chamber decreases until a prescribed quantity of the fuel is deposited on the intake port. As this state would result in a lean air-fuel ratio, a correction is made for the fuel deposited on the wall. Specifically, a correction is made to increase the fuel injection quantity. Here, the correction is made using the intake manifold injector. The correction is made for the fuel deposited on the wall using the intake manifold injector, and not the in-cylinder injector, based on the following reason. The fuel deposited on the wall of the intake manifold is originally formed by the fuel injected from the intake manifold injector, and it is not attributed to the in-cylinder injector. Due to the fuel injected from the intake manifold injector being deposited on the wall, a quantity of the fuel suctioned into the cylinder fluctuates. Accordingly, by making a correction for the fuel injection quantity of the intake manifold injector, the quantity of the fuel suctioned into the cylinder can be made substantially the same as in the case where no deposit on the wall is assumed, and a true injection ratio is prevented from being changed. As a result, the control apparatus for an internal combustion engine in which the first and second fuel injection mechanisms bear shares, respectively, of injecting the fuel can be provided, that can make a correction appropriately for the fuel deposited on the wall without largely changing the injection ratio of the fuel injection quantity.

Preferably, the control apparatus for an internal combustion engine further includes, in addition to the constituents in the first aspect of the present invention, a sensor sensing a temperature of the internal combustion engine. The controller controls the first and second injection mechanisms so that a correction for the wall-deposited fuel is made using the second fuel injection mechanism, when the temperature satisfies a predetermined condition.

According to the present invention, when a request that increases a load to the internal combustion engine arises when the in-cylinder injector and the intake manifold injector bear shares, respectively, of injecting the fuel (0<DI ratio r<1), both of the fuel injection quantity of the in-cylinder injector and that of the intake manifold injector increase. Here, the fuel suctioned into the combustion chamber (into the cylinder) decreases until a prescribed quantity of fuel is deposited on the intake manifold (intake port). As this state would result in a lean air-fuel ratio, a correction is made for the fuel deposited on the wall. Here, the correction is made using the intake manifold injector when a condition that the temperature of the internal combustion engine is high is satisfied, for example. Additionally, if a DI ratio r (0<r) decreases stepwise (with a load to the internal combustion engine being the same) when the in-cylinder injector and the intake manifold injector) bear shares, respectively, of injecting the fuel (0<DI ratio r<1), the fuel injection quantity of the intake manifold injector increases stepwise. Here, the fuel suctioned into the combustion chamber decreases until a prescribed quantity of the fuel is deposited on the intake port. As this state would result in a lean air-fuel ratio, a correction is made for the fuel deposited on the wall. Here, the correction is made using the intake manifold injector when a condition that the temperature of the internal combustion engine is high is satisfied, for example. When such a temperature condition is satisfied, the temperature of the intake manifold is also high and the quantity of the fuel deposited on the wall of the intake manifold is small. Further, difference in the fuel properties does not exert major effect. Accordingly, the correction for the fuel deposited on the wall is made using the intake manifold injector, and not the in-cylinder injector. By making a correction for the fuel injection quantity of the intake manifold injector, the quantity of the fuel suctioned into the cylinder can be made substantially the same as in the case where no deposit on the wall is assumed, and a true injection ratio is prevented from being changed.

Further preferably, the controller controls the first and second injection mechanisms so that a correction for the wall-deposited fuel is made using the second fuel injection mechanism, when a condition that the temperature of the internal combustion engine is higher than a predetermined temperature is satisfied.

According to the present invention, when the temperature of the internal combustion engine is high, the temperature of the intake manifold is also high and the quantity of the fuel deposited on the wall of the intake manifold is small. Additionally, difference in fuel properties (in particular, the boiling point) does not exert major effect (evaporation is readily achieved). In such a case, if a correction is made for the fuel deposited on the wall using the intake manifold injector, the quantity of the fuel suctioned into the cylinder can quickly be increased. Thus, sluggish start of the vehicle or deterioration in drivability due to hesitation can be prevented. Additionally, the injection ratio of the fuel injection quantity can be prevented from being largely changed. Accordingly, in such a case, a correction for the fuel deposited on the wall is made using the intake manifold injector.

Further preferably, the controller controls the first and second injection mechanisms so that a correction for the wall-deposited fuel is made using the first fuel injection mechanism, when a condition that the temperature of the internal combustion engine is higher than a predetermined temperature is unsatisfied.

According to the present invention, when the temperature of the internal combustion engine is not high, the temperature of the intake manifold is also low and the fuel deposited on the wall of the intake manifold increases. Additionally, difference in fuel properties exerts major effect. In such a case, if a correction for the fuel deposited on the wall is made using the intake manifold injector, the quantity of the fuel suctioned into the cylinder cannot be increased quickly, and therefore sluggish start of the vehicle or deterioration in drivability due to hesitation cannot be solved quickly. Therefore, in such a case, a correction for the fuel deposited on the wall is made using the in-cylinder injector, and not the intake manifold injector.

Further preferably, the sensor senses a temperature of a coolant of the internal combustion engine.

According to the present invention, by sensing the temperature of the coolant of the internal combustion engine, the temperature of the engine can be sensed. Therefore, based on the temperature of the engine easily, whether a correction for the fuel deposited on the wall is made using the intake manifold injector or using the in-cylinder injector can precisely be determined.

Further preferably, the first fuel injection mechanism is an in-cylinder injector and the second fuel injection mechanism is an intake manifold injector.

According to the present invention, a control apparatus for an internal combustion engine provided with the in-cylinder injector that is the first fuel injection mechanism and the intake manifold injector that is the second fuel injection mechanism separately to bear respective shares of a fuel injection quantity can be provided, that can make a correction appropriately for the fuel deposited on the wall of the intake manifold without largely changing the injection ratio of the fuel injection quantity.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
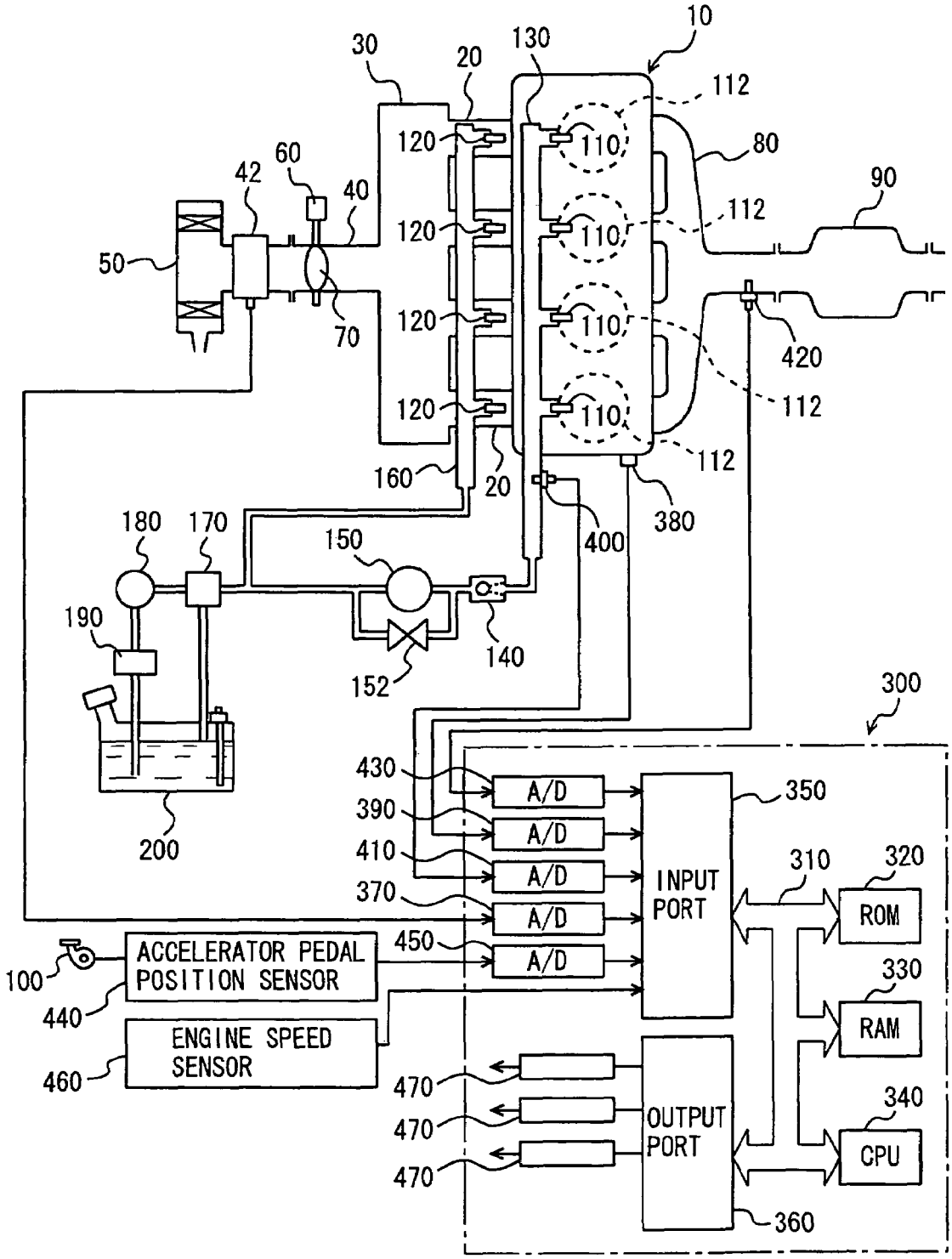
FIG. 1 is a schematic configuration diagram of an engine system controlled by a control apparatus according to an embodiment of the present invention.

Hereinafter, an embodiment of the present invention will be described with reference to the drawings. In the following description, the same parts have the same reference characters allotted and also have the same names and functions. Thus, detailed description thereof will not be repeated.

FIG. 1 is a schematic configuration diagram of an engine system that is controlled by an engine ECU (Electronic Control Unit) implementing the control apparatus for an internal combustion engine according to an embodiment of the present invention. In FIG. 1, an in-line 4-cylinder gasoline engine is shown, although the application of the present invention is not restricted to such an engine.

As shown in FIG. 1, the engine 10 includes four cylinders 112, each connected via a corresponding intake manifold 20 to a common surge tank 30. Surge tank 30 is connected via an intake duct 40 to an air cleaner 50. An airflow meter 42 is arranged in intake duct 40, and a throttle valve 70 driven by an electric motor 60 is also arranged in intake duct 40. Throttle valve 70 has its degree of opening controlled based on an output signal of an engine ECU 300, independently from an accelerator pedal 100. Each cylinder 112 is connected to a common exhaust manifold 80, which is connected to a three-way catalytic converter 90.

Each cylinder 112 is provided with an in-cylinder injector 110 for injecting fuel into the cylinder and an intake manifold injector 120 for injecting fuel into an intake port or/and an intake manifold. Injectors 110 and 120 are controlled based on output signals from engine ECU 300. Further, in-cylinder injector 110 of each cylinder is connected to a common fuel delivery pipe 130. Fuel delivery pipe 130 is connected to a high-pressure fuel pump 150 of an engine-driven type, via a check valve 140 that allows a flow in the direction toward fuel delivery pipe 130. In the present embodiment, an internal combustion engine having two injectors separately provided is explained, although the present invention is not restricted to such an internal combustion engine. For example, the internal combustion engine may have one injector that can effect both in-cylinder injection and intake manifold injection.

As shown in FIG. 1, the discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is stopped. Electromagnetic spill valve 152 is controlled based on an output signal of engine ECU 300.

More specifically, in high-pressure fuel pump 150 that pressurizes the fuel with a pump plunger which is moved upward and downward by means of a cum attached to a cum shaft, electromagnetic spill valve 152 is provided on a pump intake side and has its timing of closing in a pressurizing stroke feedback-controlled by engine ECU 300 using a fuel pressure sensor 400 provided at fuel delivery pipe 300. Thus, a pressure of fuel (fuel pressure) inside fuel delivery pipe 130 is controlled. In other words, controlling electromagnetic spill valve 152 by engine ECU 300, the quantity and pressure of the fuel supplied from high-pressure fuel pump 150 to fuel delivery pipe 130 are controlled.

Each intake manifold injector 120 is connected to a common fuel delivery pipe 160 on a low pressure side. Fuel delivery pipe 160 and high-pressure fuel pump 150 are connected via a common fuel pressure regulator 170 to a low-pressure fuel pump 180 of an electric motor-driven type. Further, low-pressure fuel pump 180 is connected via a fuel filter 190 to a fuel tank 200. Fuel pressure regulator 170 is configured to return a part of the fuel discharged from low-pressure fuel pump 180 back to fuel tank 200 when the pressure of the fuel discharged from low-pressure fuel pump 180 is higher than a preset fuel pressure. This prevents both the-pressure of the fuel supplied to intake manifold injector 120 and the pressure of the fuel supplied to high-pressure fuel pump 150 from becoming higher than the above-described preset fuel pressure.

Engine ECU 300 is implemented with a digital computer, and includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage is input via an A/D converter 370 to input port 350. A coolant temperature sensor 380 is attached to engine 10, and generates an output voltage proportional to a coolant temperature of the engine, which is input via an AID converter 390 to input port 350.

A fuel pressure sensor 400 is attached to fuel delivery pipe 130, and generates an output voltage proportional to a fuel pressure within fuel delivery pipe 130, which is input via an A/D converter 410 to input port 350. An air-fuel ratio sensor 420 is attached to an exhaust manifold 80 located upstream of three-way catalytic converter 90. Air-fuel ratio sensor 420 generates an output voltage proportional to an oxygen concentration within the exhaust gas, which is input via an A/D converter 430 to input port 350.

Air-fuel ratio sensor 420 of the engine system of the present embodiment is a full-range air-fuel ratio sensor (linear air-fuel ratio sensor) that generates an output voltage proportional to the air-fuel ratio of the air-fuel mixture burned in engine 10. As air-fuel ratio sensor 420, an $O_2$ sensor may be employed, which detects, in an on/off manner, whether the air-fuel ratio of the air-fuel mixture burned in engine 10 is rich or lean with respect to a stoichiometric air-fuel ratio.

Accelerator pedal 100 is connected with an accelerator pedal position sensor 440 that generates an output voltage proportional to the degree of press down of accelerator pedal 100, which is input via an A/D converter 450 to input port 350. Further, an engine speed sensor 460 generating an output pulse representing the engine speed is connected to input port 350. ROM 320 of engine ECU 300 prestores, in the form of a map, values of fuel injection quantity that are set in association with operation states based on the engine load factor and the engine speed obtained by the above-described accelerator pedal position sensor 440 and engine speed sensor 460, and correction values thereof set based on the engine coolant temperature.

Figure 2:
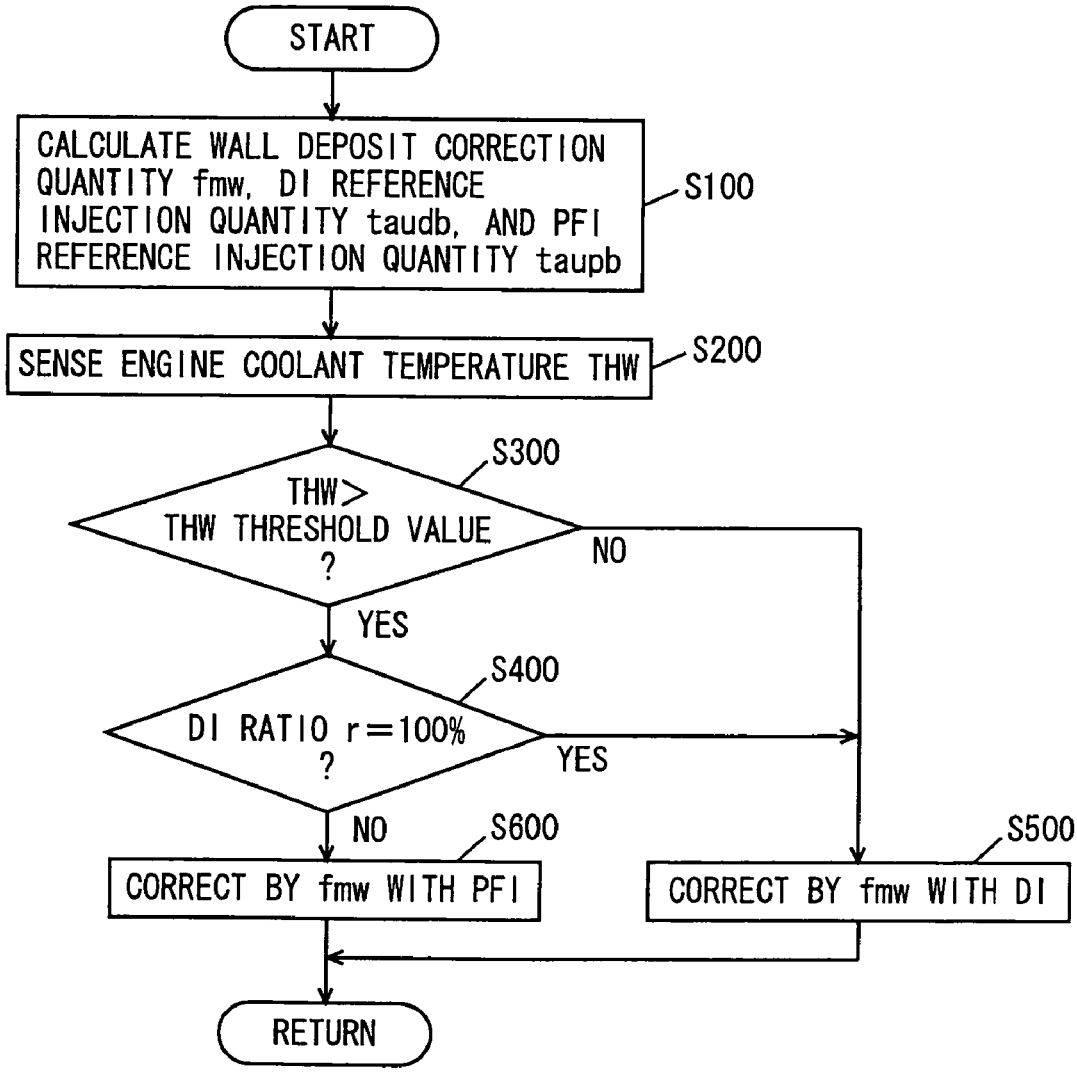
FIG. 2 is a flowchart illustrating a control structure of a program that is executed by an engine ECU implementing the control apparatus according to the embodiment of the present invention.

Referring to FIG. 2, a control structure of a program that is executed at engine ECU 300 implementing the control apparatus according to an embodiment of the present invention will be described. It is noted that the flowchart is executed at predetermined time cycles of calculation, or at a predetermined crank angle of engine 10.

In step (hereinafter step is abbreviated as S) 100, engine ECU 300 calculates a wall deposit correction quantity fmw, a DI reference injection quantity taudb of in-cylinder injector 110, and a PFI reference injection quantity taupb of intake manifold injector 120.

Here, DI reference injection quantity taudb of in-cylinder injector 110 is calculated as follows:

$$taudb = r \times EQMAX \times klfwd \times fafd \times kgd \times kpr \quad (1)$$

PFI reference injection quantity taupb of intake manifold injector 120 is calculated as follows:

$$taupb = k \times (1-r) \times EQMAX \times klfwd \times fafp \times kgp \quad (2)$$

In equations (1) and (2), r is a fuel injection ratio (DI ratio), EQMAX is a maximum injection quantity, klfwd is a load factor, fafd and fafp are feedback coefficients in a stoichiometric state, kgd is a learning value of in-cylinder injector 110, kpr is a conversion coefficient corresponding to a fuel pressure, and kgp is a learning value of intake manifold injector 120.

Figure 3:
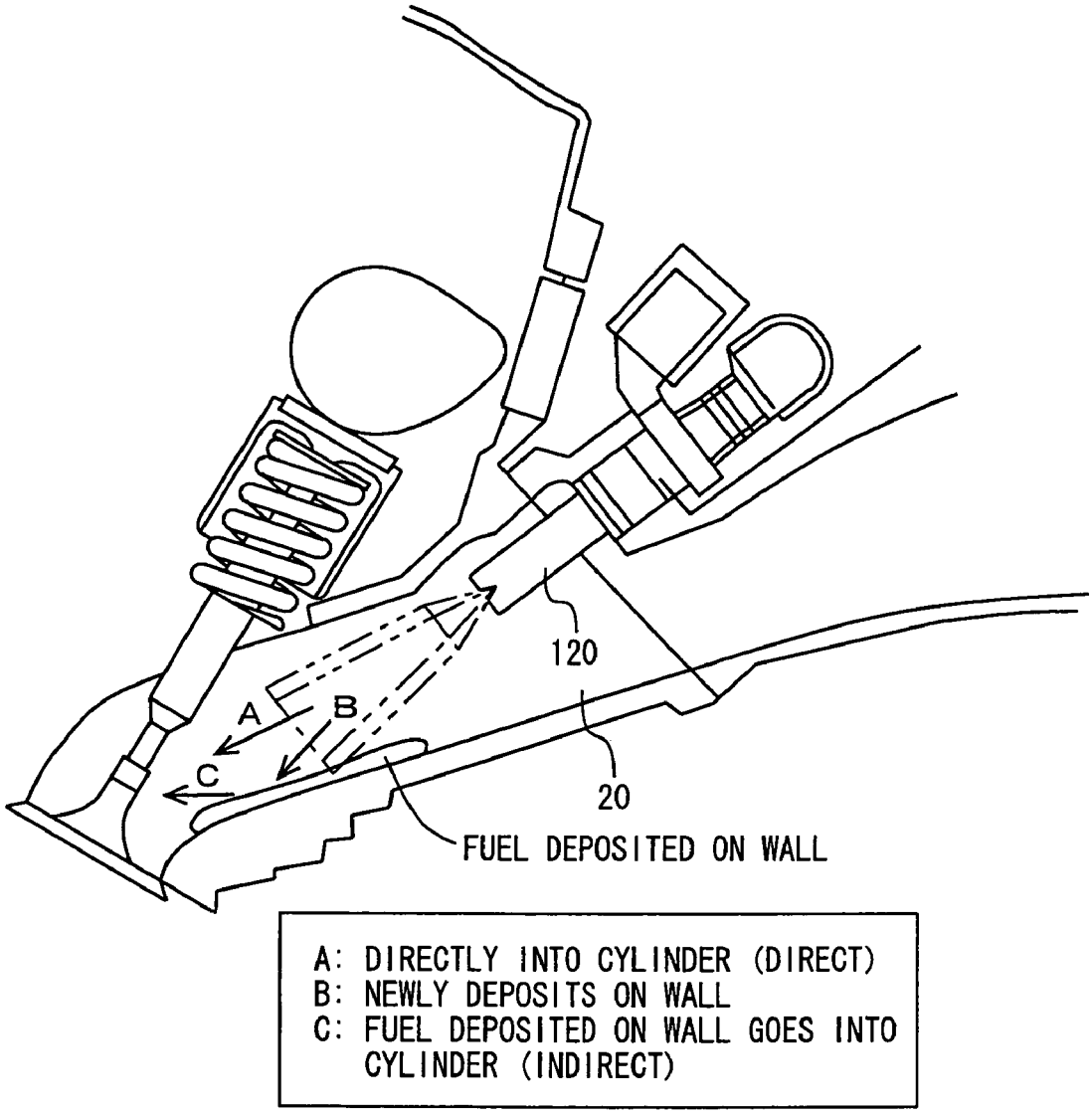
FIG. 3 shows a state of wall deposit.

Wall deposit correction quantity fmw is described below. As shown in FIG. 3, the fuel injected from intake manifold injector 123 deposits on intake manifold 20, depending on its fuel properties (for example, in a greater quantity as the boiling point is higher). Part of the fuel injected from intake manifold injector 120 is directly suctioned into the cylinder as indicated by arrow A. The remainder of the fuel injected from intake manifold injector 120 is newly deposited on the wall of the intake manifold as indicated by arrow B. Out of the fuel thus deposited on the wall, fuel that evaporates by the heat of the intake manifold (that has been deposited on the wall) is indirectly suctioned into the cylinder as indicated by arrow C, by means of injection from intake manifold injector 120 or by means of an intake air current when the intake port opens.

Figure 4:
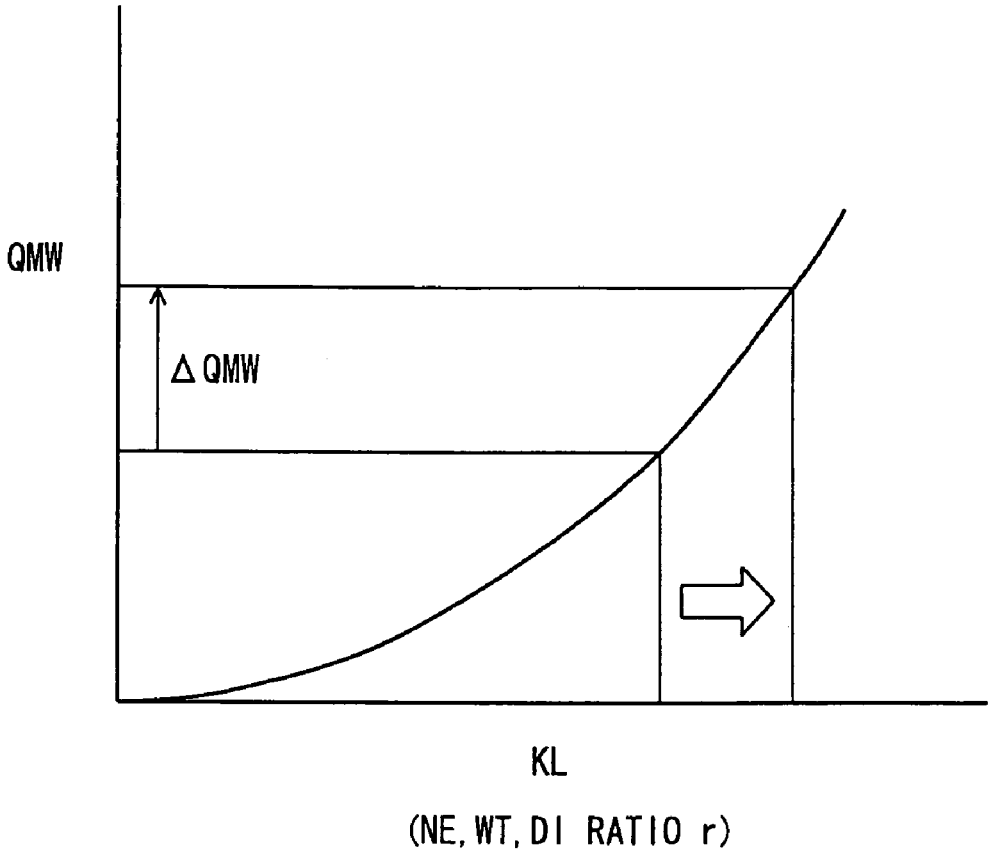
FIG. 4 shows a correction quantity of a wall-deposited fuel that varies in accordance with variations in a load.

FIG. 4 shows a state of wall-deposited fuel quantity QMW in a steady state of engine 10 relative to a load factor KL of engine 10. It is noted that wall-deposited fuel quantity QMW depends not only on load factor KL but also on an engine speed NE, a variable valve timing VVT, and a DI ratio r, although FIG. 4 shows dependency on load factor KL of engine 10 for the sake of simplifying. As shown in FIG. 4, when load factor KL increases, wall-deposited fuel quantity QMW increases by ΔQMW. Here, engine ECU 300 that is the control apparatus for an internal combustion engine according to the embodiment of the present invention does not calculate wall deposit correction quantity fmw adopting ΔQMW that is an increase in the fuel deposited on the port wall, and instead, it calculates wall deposit correction quantity fmw associated with an increase in the load factor, adopting a quantity of the fuel directly entering into the cylinder (the fuel indicated by arrow A) and a quantity of the fuel indirectly entering into the cylinder (the fuel indicated by arrow C). Correction quantity fmw is calculated as follows:

$$fmw = KMW(1) \times \Delta QMW + KMW(2) \times QTRN(K-1) \quad (3)$$

In equation (3), KMW(1) is a ratio of the fuel directly suctioned into the cylinder (0<KMW(1)<1), KMW(2) is a ratio of the fuel indirectly suctioned into the cylinder (0<KMW(2)<1), and QTRN(K−1) is a wall deposit fuel quantity at present (strictly, at a time point that is one cycle prior to the calculation time). Wall-deposited fuel quantity QTRN(K) is calculated for each cycle of the calculation time. As such, the next wall-deposited fuel quantity QTRN (K) is calculated as follows, employing wall-deposited fuel quantity QTRN(K−1) one cycle before:

$$QTRN(K)=(1-KMW(1))\times\Delta QMW+(1-KMW(2))\times QTRN(K-1) \quad (4)$$

The first term of equation (4), (1−KMW(1))×ΔQMW, is a quantity of fuel that is not directly suctioned into the cylinder and that is newly deposited on the wall, and the second term of equation (4), (1−KMW(2))×QTRN(K−1), is a quantity of fuel that is not indirectly suctioned into the cylinder and that is left in the intake manifold.

Thus, from equations (3) and (4), correction quantity fmw is calculated. The description of the flowchart is given in the following, assuming that load factor KL increases as above.

In S200, engine ECU 300 senses an engine coolant temperature THW. Here, engine coolant temperature THW is sensed based on a signal input from coolant temperature sensor 380 to engine ECU 300.

In S300, engine ECU 300 determines whether or not engine coolant temperature THW is higher than a THW threshold value. This THW threshold value is set to about 60° C., for example. If engine coolant temperature THW is higher than THW threshold value (YES in S300), then the process proceeds to S400. Otherwise (NO in S300), the process proceeds to S500.

In S400, engine ECU 300 determines whether or not DI ratio r=100%. If DI ratio r=100% (YES in S400), then the process proceeds to S500. Otherwise (NO in S400), the process proceeds to S600.

In S500, engine ECU 300 allows in-cylinder injector 110 to inject the fuel being increased by wall deposit correction quantity fmw, so that the fuel deposited on the wall is corrected with in-cylinder injector 110.

In S600, engine ECU 300 allows intake manifold injector 120 to inject the fuel being increased by wall deposit correction quantity fmw, so that the fuel deposited on the wall is corrected with intake manifold injector 120.

An operation of engine 10 controlled by engine ECU 300 implementing the control apparatus for an internal combustion engine of the present embodiment based on the above-described structure and flowchart will now be described, referring to the timing chart of FIG. 5.

Figure 5:
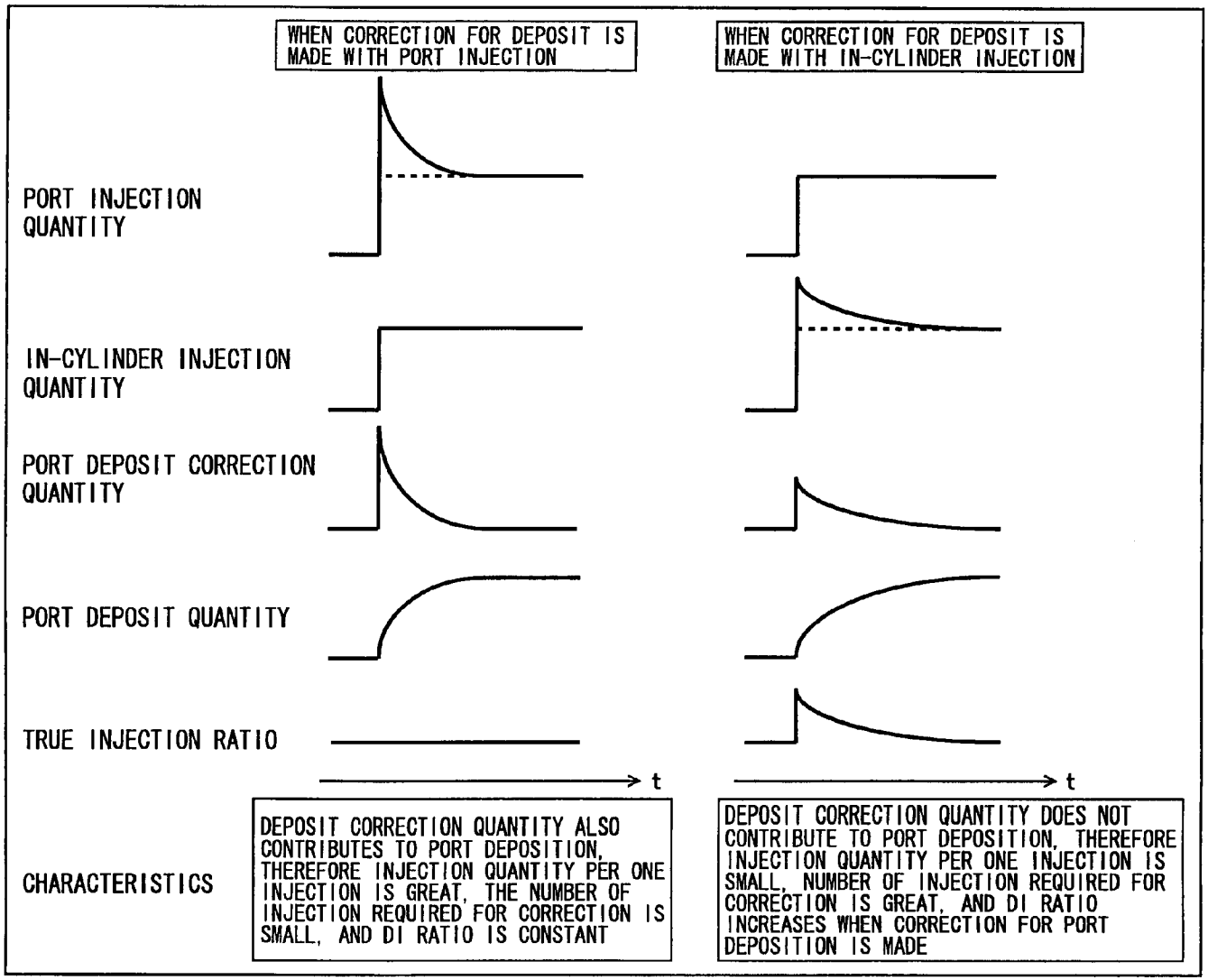
FIG. 5 is a timing chart (1) showing variations in each state quantity.

FIG. 5 shows temporal variations of a port injection quantity, an in-cylinder injection quantity, a port deposit correction quantity, a port deposit quantity, and a true injection ratio, in each case when a correction is made for the fuel deposited on the wall using intake manifold injector 110 and when a correction is made for the fuel deposited on the wall using in-cylinder injector 120.

When intake manifold injector 110 and in-cylinder injector 120 both inject fuel (YES in S300, NO in S400), a correction for the wall deposit is made using intake manifold injector 120. Thus, as indicated by the true injection ratio in FIG. 5, control of engine 10 is appropriately achieved, without largely deviating from the target injection ratio.

Originally, the fuel deposited on the wall of the intake manifold is formed by the fuel injected from intake manifold injector 120, and it is not attributed to in-cylinder injector 110. As the fuel injected from intake manifold injector 120 deposits on the wall, the quantity of the fuel suctioned into the cylinder decreases. Accordingly, by correcting a fuel injection quantity from intake manifold injector 120, the fuel quantity suctioned into the cylinder can substantially be made substantially the same as in the case where no deposit on the wall is assumed. Thus, the true fuel injection ratio is prevented from being changed.

Figure 6:
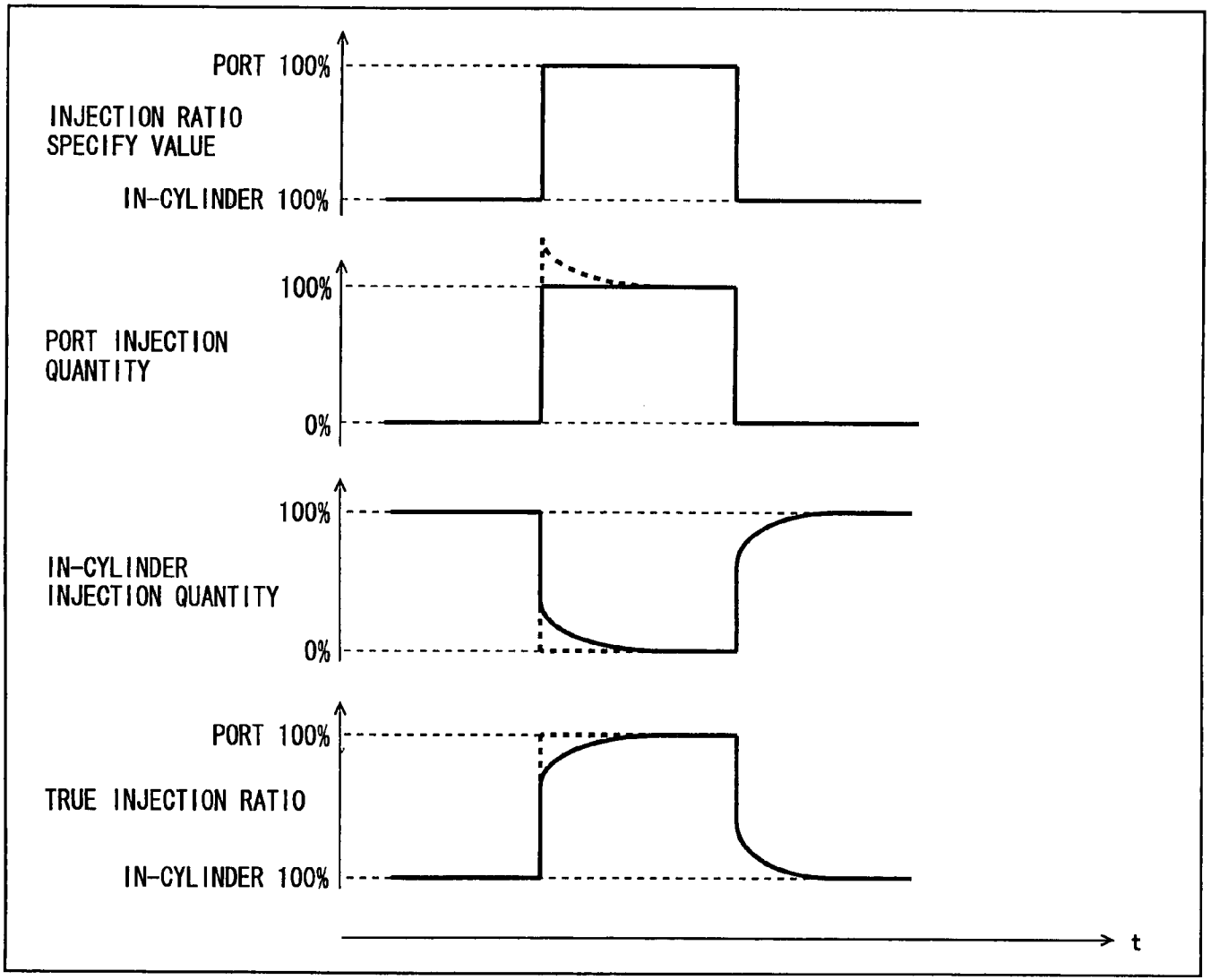
FIG. 6 is a timing chart (2) showing variations in each state quantity.

FIG. 6 shows temporal variations of an injection ratio specify value, a port injection quantity of intake manifold injector 120, an in-cylinder injection quantity of in-cylinder injector 110, and a true injection ratio, when there is a stepwise change from DI ratio r=100% to DI ratio r=0%. A correction for the fuel deposited on the wall using intake manifold injector 110 is indicated by a solid line, while a correction for the fuel deposited on the wall using in-cylinder injector 120 is indicated by a dashed line.

FIG. 6 shows states being switched, from a state where intake manifold injector 120 does not inject fuel and in-cylinder injector 110 solely injects the fuel, to a state where injection of the fuel from in-cylinder injector 110 is stopped and intake manifold injector 120 solely injects the fuel. As such, the fuel is not suctioned into the cylinder but it deposits on the wall of the intake manifold in a quantity accumulated from a zero state up to a saturation state. Accordingly, a correction for this quantity as the wall-deposited fuel is made.

When the correction is made using in-cylinder injector 110 as indicated by the solid line, the correction is not made by decreasing stepwise the fuel injection quantity of in-cylinder injector 110 (in-cylinder injection quantity). Instead, the correction is continuously made while injection of a small quantity of fuel is gradually decreased for a prescribed period (the in-cylinder injection quantity indicated by the solid line in FIG. 6).

When a correction is made using intake manifold cylinder 120 as indicated by the dashed line, the correction is not made by increasing stepwise the fuel injection quantity of intake manifold cylinder 120 (port injection quantity). Instead, the correction is continuously made while injection of fuel having been increased by a correction quantity is gradually decreased for a prescribed period (the port injection quantity indicated by the dashed line in FIG. 6).

Thus, if the correction for the fuel deposited on the wall is made using intake manifold injector 120 when there is a stepwise change of DI ratio r=100% to DI ratio r=0%, then the true injection ratio meets the injection ratio specify value. If the correction for the fuel deposited on the wall is made using in-cylinder injector 110, then the true injection ratio does not meet the injection ratio specify value (a smoothed portion in the true injection ratio appears).

When engine coolant temperature THW is at most THW threshold value (in a cold state) (NO in S300), the temperature of the intake manifold is also low and the fuel deposited on the wall of the intake manifold increases. Additionally, difference in the fuel properties exerts a significant effect. In such a case, if the correction for the fuel deposited on the wall is made using intake manifold injector 120, the quantity of the fuel suctioned into the cylinder cannot be increased quickly. Accordingly, sluggish start of the vehicle or deterioration in drivability due to hesitation cannot be solved quickly. Thus, the correction for the fuel deposited on the wall is made using in-cylinder injector 110, and not intake manifold injector 120.

As above, when the in-cylinder injector and the intake manifold injector both inject fuel not in a cold state, by making a correction for the fuel deposited on the wall of the intake manifold using the intake manifold injector, the desired injection ratio can be realized. In the cold state, by making a correction for the fuel deposited on the wall of the intake manifold using the in-cylinder injector, the correction for the fuel deposited on the wall can quickly be made.

Engine (1) to Which Present Control Apparatus is Suitably Applied

An engine (1) to which the control apparatus of the present embodiment is suitably applied will now be described.

Figure 7:
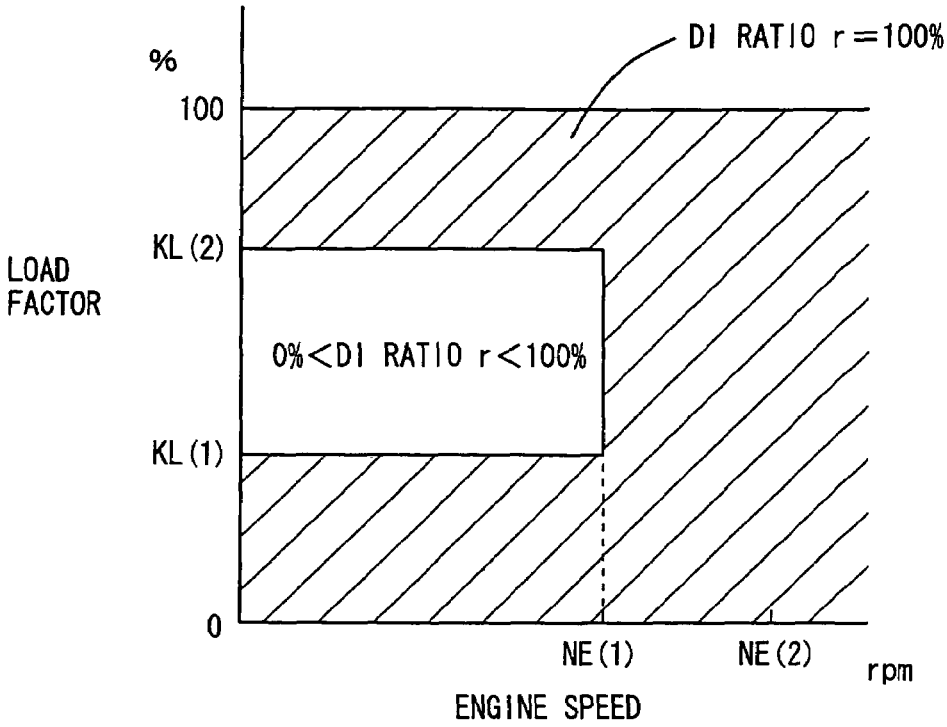
FIG. 7 shows a DI ratio map (1) for a warm state of an engine to which the control apparatus according to the present embodiment of the present invention is suitably applied.
Figure 8:
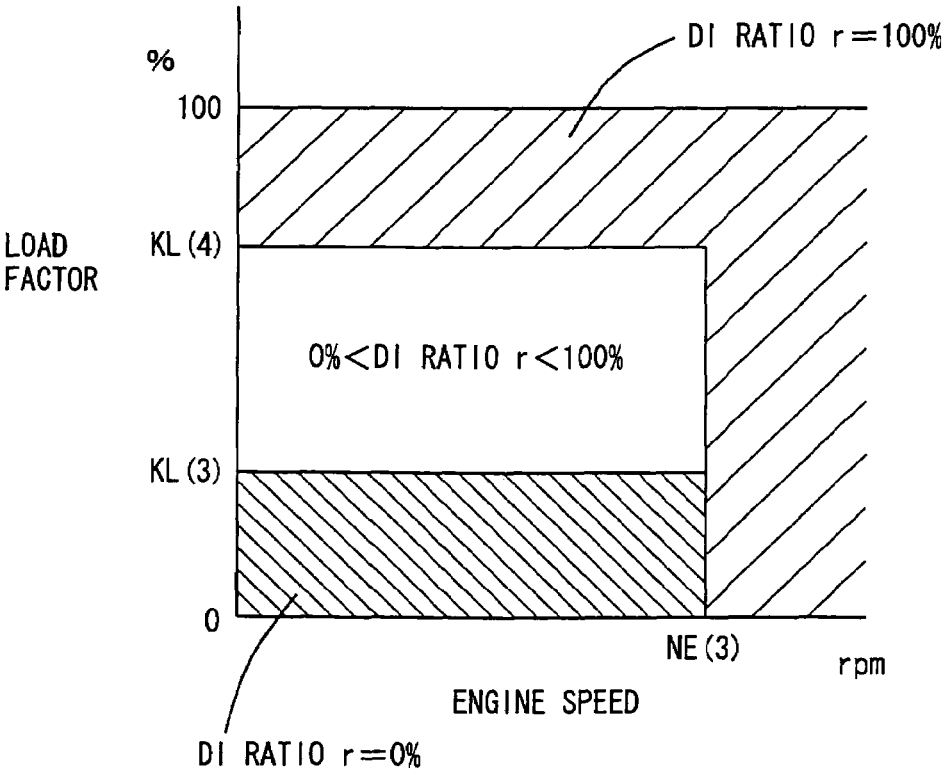
FIG. 8 shows a DI ratio map (1) for a cold state of an engine to which the control apparatus according to the present embodiment of the present invention is suitably applied.

Referring to FIGS. 7 and 8, maps each indicating a fuel injection ratio between in-cylinder injector 110 and intake manifold injector 120, identified as information associated with an operation state of engine 10, will now be described. Herein, the fuel injection ratio between the two injectors is also expressed as a ratio of the quantity of the fuel injected from in-cylinder injector 110 to the total quantity of the fuel injected, which is referred to as the "fuel injection ratio of in-cylinder injector 110", or a "DI (Direct Injection) ratio (r)". The maps are stored in ROM 320 of engine ECU 300. FIG. 7 is the map for a warm state of engine 10, and FIG. 8 is the map for a cold state of engine 10.

In the maps illustrated in FIGS. 7 and 8, with the horizontal axis representing an engine speed of engine 10 and the vertical axis representing a load factor, the fuel injection ratio of in-cylinder injector 110, or the DI ratio r, is expressed in percentage.

As shown in FIGS. 7 and 8, the DI ratio r is set for each operation range that is determined by the engine speed and the load factor of engine 10. "DI RATIO r=100%" represents the range where fuel injection is carried out using only in-cylinder injector 110, and "DI RATIO r=0%" represents the range where fuel injection is carried out using only intake manifold injector 120. "DI RATIO r≠0%", "DI RATIO r≠100%" and "0%<DI RATIO r<100%" each represent the range where fuel injection is carried out using both in-cylinder injector 110 and intake manifold injector 120. Generally, in-cylinder injector 110 contributes to an increase of output performance, while intake manifold injector 120 contributes to uniformity of the air-fuel mixture. These two kinds of injectors having different characteristics are appropriately selected depending on the engine speed and the load factor of engine 10, so that only homogeneous combustion is conducted in the normal operation state of the engine (other than the abnormal operation state such as a catalyst warm-up state during idling).

Further, as shown in FIGS. 7 and 8, the fuel injection ratio between in-cylinder injector 110 and intake manifold injector 120, or, the DI ratio r, is defined individually in the map for the warm state and in the map for the cold state of the engine. The maps are configured to indicate different control ranges of in-cylinder injector 110 and intake manifold injector 120 as the temperature of engine 10 changes. When the temperature of engine 10 detected is equal to or higher than a predetermined temperature threshold value, the map for the warm state shown in FIG. 7 is selected; otherwise, the map for the cold state shown in FIG. 8 is selected. One or both of in-cylinder injector 1 10 and intake manifold injector 120 are controlled based on the selected map and according to the engine speed and the load factor of engine 10.

The engine speed and the load factor of engine 10 set in FIGS. 7 and 8 will now be described. In FIG. 7, NE(1) is set to 2500 rpm to 2700 rpm, KL(1) is set to 30% to 50%, and KL(2) is set to 60% to 90%. In FIG. 8, NE(3) is set to 2900 rpm to 3100 rpm. That is, NE(1)<NE(3). NE(2) in FIG. 7 as well as KL(3) and KL(4) in FIG. 8 are also set as appropriate.

When comparing FIGS. 7 and 8, NE(3) of the map for the cold state shown in FIG. 8 is greater than NE(1) of the map for the warm state shown in FIG. 7. This shows that, as the temperature of engine 10 is lower, the control range of intake manifold injector 120 is expanded to include the range of higher engine speed. That is, in the case where engine 10 is cold, deposits are unlikely to accumulate in the injection hole of in-cylinder injector 110 (even if the fuel is not injected from in-cylinder injector 110). Thus, the range where the fuel injection is to be carried out using intake manifold injector 120 can be expanded, to thereby improve homogeneity.

When comparing FIGS. 7 and 8, "DI RATIO r=100%" in the range where the engine speed of engine 10 is NE(1) or higher in the map for the warm state, and in the range where the engine speed is NE(3) or higher in the map for the cold state. In terms of load factor, "DI RATIO r=100%" in the range where the load factor is KL(2) or greater in the map for the warm state, and in the range where the load factor is KL(4) or greater in the map for the cold state. This means that in-cylinder injector 110 solely is used in the range of a predetermined high engine speed, and in the range of a predetermined high engine load. That is, in the high speed range or the high load range, even if fuel injection is carried out using only in-cylinder injector 110, the engine speed and the load of engine 10 are high, ensuring a sufficient intake air quantity, so that it is readily possible to obtain a homogeneous air-fuel mixture even using only in-cylinder injector 110. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In the map for the warm state in FIG. 7, fuel injection is also carried out using only in-cylinder injector 110 when the load factor is KL(1) or less. This shows that in-cylinder injector 110 alone is used in a predetermined low load range when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 110 may be prevented while ensuring the minimum fuel injection quantity thereof. Thus, in-cylinder injector 110 alone is used in the relevant range.

When comparing FIGS. 7 and 8, there is a range of "DI RATIO r=0%" only in the map for the cold state in FIG. 8. This shows that fuel injection is carried out using only intake manifold injector 120 in a predetermined low load range (KL(3) or less) when the temperature of engine 10 is low. When engine 10 is cold and low in load and the intake air quantity is small, atomization of the fuel is unlikely to occur. In such a range, it is difficult to ensure favorable combustion with the fuel injection from in-cylinder injector 110. Further, particularly in the low-load and low-speed range, high output using in-cylinder injector 110 is unnecessary. Accordingly, fuel injection is carried out using only intake manifold injector 120, rather than in-cylinder injector 110, in the relevant range.

Further, in an operation other than the normal operation, or, in the catalyst warm-up state during idling of engine 10 (abnormal operation state), in-cylinder injector 110 is controlled to carry out stratified charge combustion. By causing the stratified charge combustion during the catalyst warm-up operation, warming up of the catalyst is promoted, and exhaust emission is thus improved.

Engine (2) to Which Present Control Apparatus is Suitably Applied Hereinafter, an engine (2) to which the control apparatus of the present embodiment is suitably applied will be described. In the following description of the engine (2), the configurations similar to those of the engine (1) will not be repeated.

Figure 9:
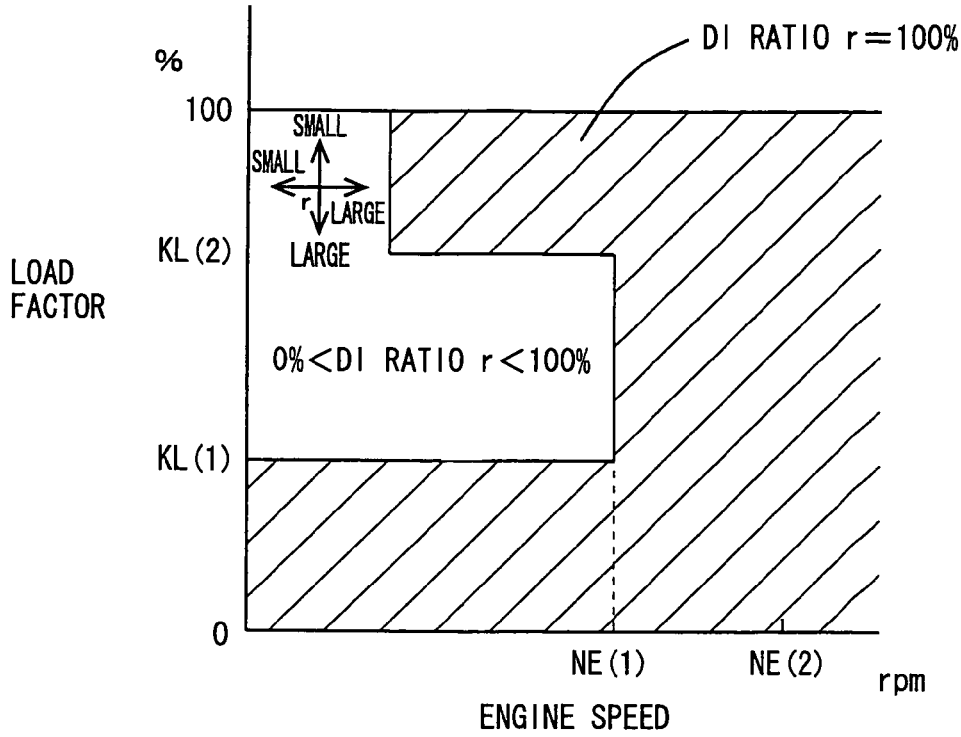
FIG. 9 shows a DI ratio map (2) for a warm state of an engine to which the control apparatus according to the present embodiment of the present invention is suitably applied.
Figure 10:
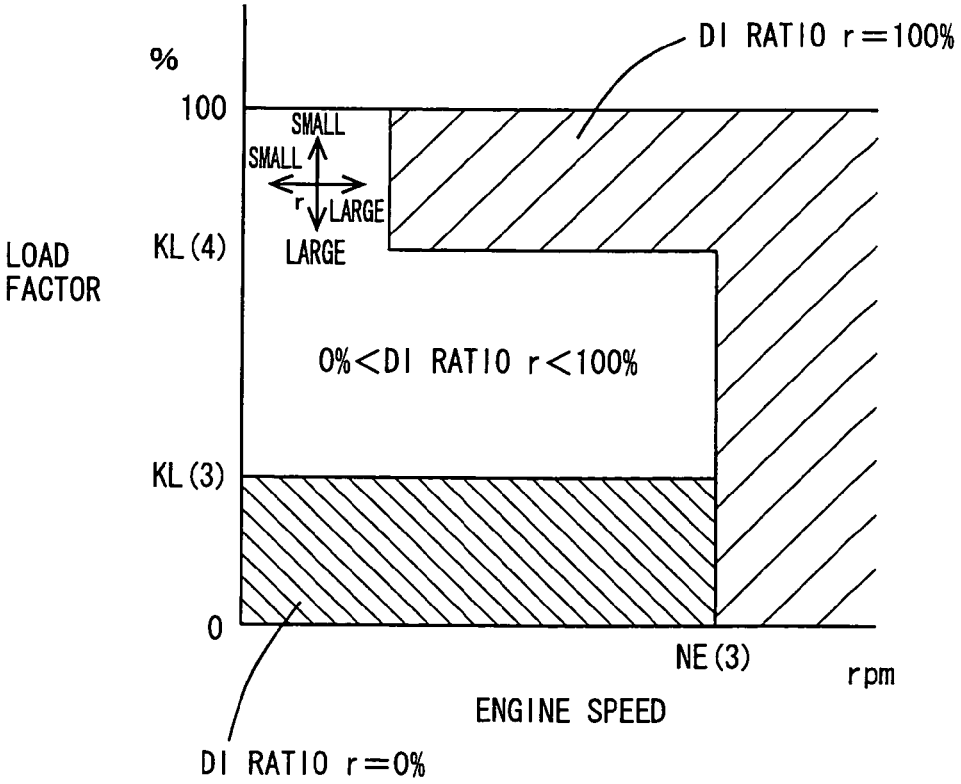
FIG. 10 shows a DI ratio map (2) for a cold state of an engine to which the control apparatus according to the present embodiment of the present invention is suitably applied.

Referring to FIGS. 9 and 10, maps each indicating the fuel injection ratio between in-cylinder injector 110 and intake manifold injector 120, identified as information associated with the operation state of engine 10, will be described. The maps are stored in ROM 320 of engine ECU 300. FIG. 9 is the map for the warm state of engine 10, and FIG. 10 is the map for the cold state of engine 10.

FIGS. 9 and 10 differ from FIGS. 7 and 8 in the following points. "DI RATIO r=100%" holds in the range where the engine speed of the engine is equal to or higher than NE(1) in the map for the warm state, and in the range where the engine speed is NE(3) or higher in the map for the cold state. Further, except for the low-speed range, "DI RATIO r=100%" holds in the range where the load factor is KL(2) or greater in the map for the warm state, and in the range where the load factor is KL(4) or greater in the map for the cold state. This means that fuel injection is carried out using only in-cylinder injector 110 in the range where the engine speed is at a predetermined high level, and that fuel injection is often carried out using only in-cylinder injector 110 in the range where the engine load is at a predetermined high level. However, in the low-speed and high-load range, mixing of an air-fuel mixture formed by the fuel injected from in-cylinder injector 110 is poor, and such inhomogeneous air-fuel mixture within the combustion chamber may lead to unstable combustion. Thus, the fuel injection ratio of in-cylinder injector 110 is increased as the engine speed increases where such a problem is unlikely to occur, whereas the fuel injection ratio of in-cylinder injector 110 is decreased as the engine load increases where such a problem is likely to occur. These changes in the fuel injection ratio of in-cylinder injector 110, or, the DI ratio r, are shown by crisscross arrows in FIGS. 9 and 10. In this manner, variation in output torque of the engine attributable to the unstable combustion can be suppressed. It is noted that these measures are approximately equivalent to the measures to decrease the fuel injection ratio of in-cylinder injector 110 as the state of the engine moves toward the predetermined low speed range, or to increase the fuel injection ratio of in-cylinder injector 110 as the engine state moves toward the predetermined low load range. Further, except for the relevant range (indicated by the crisscross arrows in FIGS. 9 and 10), in the range where fuel injection is carried out using only in-cylinder injector 110 (on the high speed side and on the low load side), a homogeneous air-fuel mixture is readily obtained even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression side, and thus, the antiknock performance improves. Further, with the temperature of the combustion chamber decreased, intake efficiency improves, leading to high power output.

In engine 10 explained in conjunction with FIGS. 7-10, homogeneous combustion is achieved by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 110 injects fuel in the compression stroke to generate a rich air-fuel mixture around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idling state) so as to cause a high-temperature combustion gas to reach the catalyst. Further, a certain quantity of fuel needs to be supplied. If the stratified charge combustion is employed to satisfy these requirements, the quantity of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine explained in conjunction with FIGS. 7-10, the fuel injection timing of in-cylinder injector 110 is set in the intake stroke in a basic range corresponding to the almost entire range (here, the basic range refers to the range other than the range where semi-stratified charge combustion is carried out with fuel injection from intake manifold injector 120 in the intake stroke and fuel injection from in-cylinder injector 110 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the injected fuel, so that the combustion rate increases. The improvement in antiknock performance and the increase in combustion rate can prevent variation in combustion, and thus, combustion stability is improved.

Further, in either the warm state or cold state, there may be no range in which fuel is injected solely from intake manifold injector 120 (DI ratio r=0%) referring to the map shown in FIG. 7 or 9. In other words, it means that there are no range where in-cylinder injector 110 is not injecting the fuel.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine having a first fuel injection mechanism injecting fuel into a cylinder and a second fuel injection mechanism injecting the fuel into an intake manifold, comprising:

a controller controlling said first and second fuel injection mechanisms to bear shares, respectively, of injecting the fuel based on a condition required for said internal combustion engine; and an estimator estimating a wall-deposited fuel of said intake manifold, wherein said controller controls said first and second fuel injection mechanisms, in a range where said first and second fuel injection mechanisms bear shares, respectively, of a fuel injection quantity, so that a correction for said wall-deposited fuel is made using said second fuel injection mechanism, and said first fuel injection mechanism is an in-cylinder injector and said second fuel injection mechanism is an intake manifold injector.

2. The control apparatus for an internal combustion engine according to claim 1, further comprising a sensor sensing a temperature of said internal combustion engine, wherein said controller controls said first and second injection mechanisms so that a correction for said wall-deposited fuel is made using said second fuel injection mechanism when said temperature satisfies a predetermined condition.

3. The control apparatus for an internal combustion engine according to claim 2, wherein said controller controls said first and second injection mechanisms so that a correction for said wall-deposited fuel is made using said second fuel injection mechanism when a condition that the temperature of said internal combustion engine is higher than a predetermined temperature is satisfied.

4. The control apparatus for an internal combustion engine according to claim 2, wherein said controller controls said first and second injection mechanisms so that a correction for said wall-deposited fuel is made using said first fuel injection mechanism when a condition that the temperature of said internal combustion engine is higher than a predetermined temperature is unsatisfied.

5. The control apparatus for an internal combustion engine according to claim 2, wherein said sensor senses a temperature of a coolant of said internal combustion engine.

6. A control apparatus for an internal combustion engine having first fuel injection means for injecting fuel into a cylinder and second fuel injection means for injecting the fuel into an intake manifold, comprising:

controlling means for controlling said first and second fuel injection means to bear shares, respectively, of injecting the fuel based on a condition required for said internal combustion engine; and estimating means for estimating a wall-deposited fuel of said intake manifold, wherein said controlling means includes means for controlling said first and second fuel injection means, in a range where said first and second fuel injection means bear shares, respectively, of a fuel injection quantity, so that a correction for said wall-deposited fuel is made using said second fuel injection means, and said first fuel injection means is an in-cylinder injector and said second fuel injection means is an intake manifold injector.

7. The control apparatus for an internal combustion engine according to claim 6, further comprising sensing means for sensing a temperature of said internal combustion engine, wherein said controlling means includes means for controlling said first and second injection means so that a correction for said wall-deposited fuel is made using said second fuel injection means when said temperature satisfies a predetermined condition.

8. The control apparatus for an internal combustion engine according to claim 7, wherein said controlling means includes means for controlling said first and second injection means so that a correction for said wall-deposited fuel is made using said second fuel injection means when a condition that the temperature of said internal combustion engine is higher than a predetermined temperature is satisfied.

9. The control apparatus for an internal combustion engine according to claim 7, wherein said controlling means includes means for controlling said first and second injection means so that a correction for said wall-deposited fuel is made using said first fuel injection means when a condition that the temperature of said internal combustion engine is higher than a predetermined temperature is unsatisfied.

10. The control apparatus for an internal combustion engine according to claim 7, wherein said sensing means includes means for sensing a temperature of a coolant of said internal combustion engine.

* * * * *